US006826872B2

(12) United States Patent
Brochu

(10) Patent No.: US 6,826,872 B2
(45) **Date of Patent: *Dec. 7, 2004**

(54) ROUNDED EAVES TROUGH WITH A GUTTER SHIELD

(76) Inventor: Guy Brochu, 2180, rue de la Rotonde, Charny, Quebec (CA), G6X 2L8

( * ) Notice: Subject to any disclaimer, the term of this patent is extended or adjusted under 35 U.S.C. 154(b) by 0 days.

This patent is subject to a terminal disclaimer.

(21) Appl. No.: 10/393,213

(22) Filed: Mar. 20, 2003

(65) Prior Publication Data

US 2004/0182014 A1 Sep. 23, 2004

(51) Int. Cl.[7] ..... E04D 13/00
(52) U.S. Cl. ..... 52/12; 52/11
(58) Field of Search ..... 52/12, 11

(56) References Cited

U.S. PATENT DOCUMENTS 3,436,878 A * 4/1969 Singer ..... 52/12
4,553,356 A * 11/1985 Pepper ..... 52/11
5,752,347 A * 5/1998 Osborn ..... 52/11
5,791,091 A * 8/1998 Barbera ..... 52/12
5,842,311 A * 12/1998 Morin ..... 52/12
6,393,770 B1 * 5/2002 Groom ..... 52/12
6,427,388 B1 * 8/2002 Brochu ..... 52/12
6,463,700 B2 * 10/2002 Davis ..... 52/12
2002/0134029 A1 * 9/2002 Groom ..... 52/12
2002/0166290 A1 * 11/2002 Bergeron ..... 52/12
2003/0009951 A1 * 1/2003 Bergeron ..... 52/12
2003/0110712 A1 * 6/2003 Brochu ..... 52/12
2004/0060244 A1 * 4/2004 Brochu ..... 052/12

FOREIGN PATENT DOCUMENTS

GB 2138046 A * 10/1984 ..... E04D/13/06

* cited by examiner

*Primary Examiner*—Peter M. Cuomo
*Assistant Examiner*—Stephen D'Adamo
(74) *Attorney, Agent, or Firm*—Eric Fincham

(57) ABSTRACT

A device for protecting a gutter wherein the gutter has a generally C-shaped portion extending from a front wall thereof, the guard member having an elongated configuration with a generally planar central portion and first and second longitudinally extending sides on either side of the generally planar central portion, a plurality of apertures extending through the generally planar central portion, a first side of the guard member having an upwardly extending portion designed to fit within the recess, and a second side of the guard member having an upwardly extending wall designed to abut the rear wall of the gutter. The device and eaves trough may be secured by placing a fastening member through the rear upper wall of the eaves through and a second side of the guard member.

8 Claims, 2 Drawing Sheets

ROUNDED EAVES TROUGH WITH A GUTTER SHIELD

The present invention relates to an eaves trough or gutter assembly and more particularly, relates to improvements in such structures.

The use of shields for gutters or eaves troughs are well known in the prior art and there have been many proposals for different types of shields. The purpose of the shield is essentially to permit the passage of rainwater from the roof to the gutter or eaves trough while protecting the same from extraneous foreign matter such as leaves, twigs, and the like.

To-date, there have been several different approaches which have been taken in the prior art. A first approach is utilizing a shield or guard which is apertured and permits passage of rainwater while attempting to bar the passage of extraneous matter. However, many of these guards do not function as desired and access must still be had to the eaves trough for cleaning purposes.

It has also been proposed in the art, in order to overcome the above disadvantages, to provide relatively complex structures such as those wherein the eaves troughs or gutters are mounted for rotatable movement so that they may be emptied at desired intervals.

A different approach which has been taken is utilizing a design wherein a cover has an outer edge which curls downwardly and the water flow follows a curved portion due to surface tension and thereafter cascades into the eaves trough. While this type of structure has been found to work under certain conditions, when the volume of water becomes sufficiently large, the surface tension is insufficient to cause all the water to flow into the gutter.

It is therefore an object of the present invention to provide a novel gutter guard which is designed to be used with certain types of round bottom eaves troughs.

It is a further object of the present invention to provide a novel eaves trough and gutter guide which eliminates the need for conventional attachment of the gutter using long nails and the like.

According to one aspect of the present invention, there is provided a device for protecting a gutter wherein the gutter has a rear wall, a front wall and a bottom wall, the walls defining a trough having an open top therebetween, the gutter also having a generally C-shaped portion extending from an upper marginal edge of the front wall and an inwardly extending flange from a distal end of the generally C-shaped portion, the generally C-shaped portion and flange defining a recess therebetween, the device comprising a guard member having an elongated configuration with a generally planar central portion, first and second longitudinally extending opposed sides located on either side of the generally planar central portion, a plurality of apertures extending through the generally planar central portion, the first side of the guard member having an upwardly extending portion designed to fit within the recess, and the second side of the guard member having an upwardly extending wall designed to abut the rear wall of the gutter.

According to a further aspect of the invention, there is provided an improvement in a building having a gutter for collecting water, the improvement wherein the gutter has an arcuate bottom wall, a rear upper wall merging therewith, and a front upper wall merging with the bottom wall, a generally C-shaped portion extending from an upper marginal edge of the front wall and an inwardly extending flange from a distal end of the generally C-shaped portion, the generally C-shaped portion and flange defining a recess therebetween; a guard member having an elongated configuration with a generally planar central portion, first and second longitudinally extending opposed sides located on either side of the generally central planar portion, a plurality of apertures extending through the generally planar central portion, the first side of the guard member having an upwardly extending portion designed to fit within the recess, and the second side of the guard member having an upwardly extending wall abutting the rear wall of the gutter, the gutter being attached by fastening means extending through the upwardly extending wall from the second side of the gutter member and the rear wall of the gutter.

The device of the present invention may be formed of any suitable material and could conveniently be formed of either a metallic or plastic material. In a preferred embodiment, the gutter and the guard will both be formed of an aluminum material as is well known in the art. However, it is within the scope of the present invention for one to use other materials and they may either be similar or dissimilar.

As previously mentioned, the device of the present invention prevents foreign matter from entering into the eaves trough. In order to do so, there are provided a plurality of apertures to permit the passage of rainwater and to prevent extraneous matter from entering the gutter or eaves trough. In general, it is desirable that appropriate sizing of the apertures be provided to accomplish the same. Naturally, the sizing can be changed according to the location where the gutters are installed.

In a preferred embodiment of the invention, the apertures will extend in diagonal rows at an angle of 45° with respect to the gutter length. Preferably, the apertures will have a size of between 2.5 and 10 mm and even more preferably between about 3.0 and 4.0 mm. As the apertures are arranged in diagonal rows, they are also preferably arranged in longitudinally extending rows. In a longitudinally extending row, the apertures are spaced apart by a distance of between 10 and 15 mm while in a diagonal row, they are spaced apart by a distance of between 5 and 10 mm.

As will be appreciated, during periods of heavy rain or the like, the drainage may not be instantaneous and accordingly, there is provided a vertically extending wall adjacent the front wall of the gutter to act as a dam or barrier to prevent overflow.

An advantage of the gutter of the present invention is that the gutter can be directly attached to the building structure through the rear wall of the gutter and an adjacent upwardly extending side wall of the guard member. In one embodiment, the second side of the guard member could terminate with a single upwardly extending wall which will abut the rear wall of the gutter. The gutter and device may then be fastened by a suitable member such as a screw or nail through the two walls directly to the structure. Alternatively, the guard member can have an inverted U-shaped configuration which will fit over the rear wall of the gutter prior to attachment.

Having thus generally described the invention, reference will be made to the accompanying drawings illustrating an embodiment thereof, in which.

Figure 1:
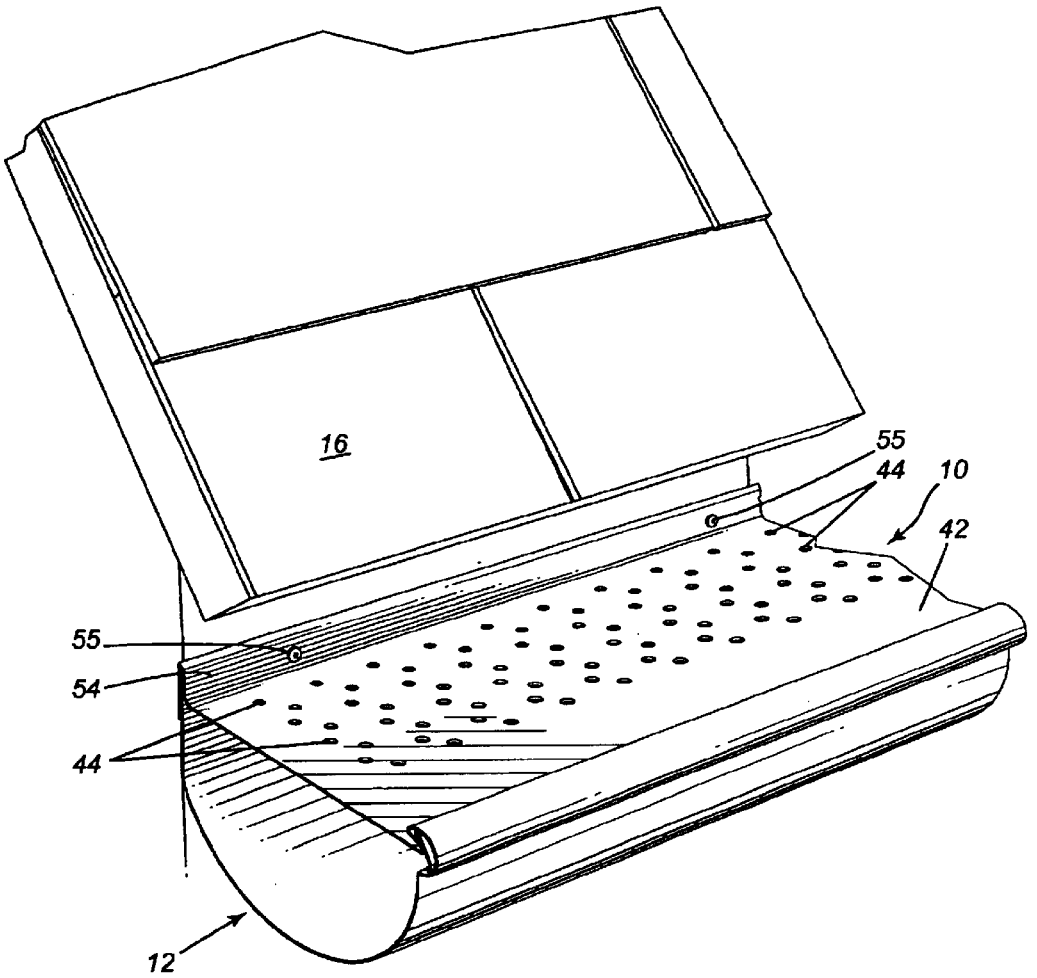
FIG. 1 is a perspective view of a portion of an eaves trough and gutter guard of the present invention, shown mounted to an adjacent structure.
Figure 2:
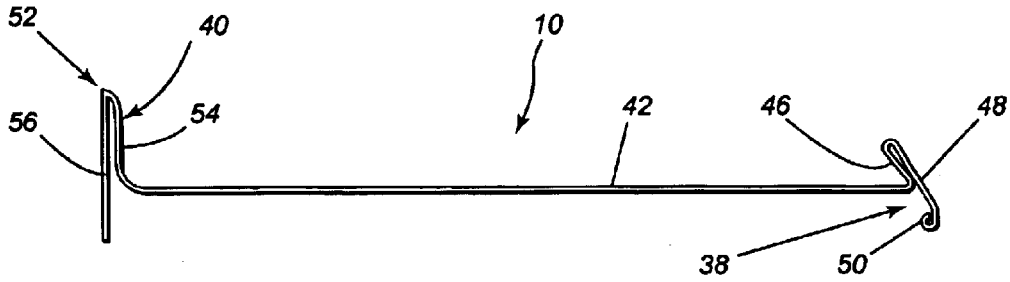
FIG. 2 is a cross sectional view of the gutter guard.

Referring to the drawings in greater detail and by reference characters thereto, there is illustrated in FIG. 1 a gutter guard according to an embodiment of the present invention and which gutter guard is generally designated by reference numeral 10. Gutter guard 10 is used in conjunction with an eaves trough 12 which lies adjacent the facia of a house structure including a roof 16.

Figure 3:
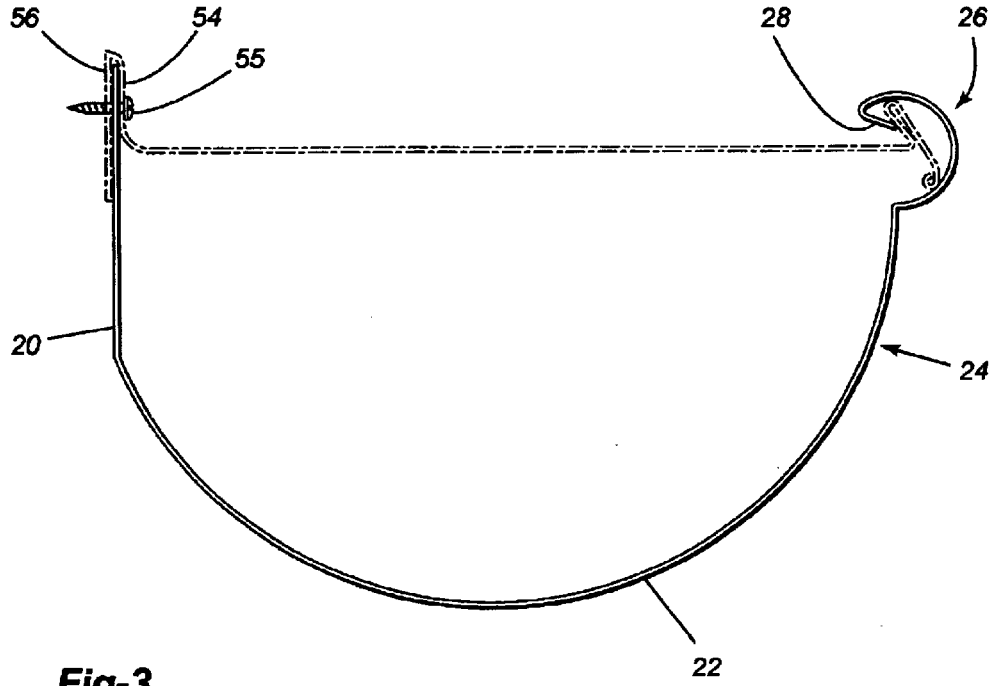
FIG. 3 is a cross sectional view of the gutter guard in place on the eaves trough.

Eaves trough or gutter 12, as may be best seen in FIG. 3, has a rear wall 20 which is of a substantially vertical configuration and which, at its lower end, merges with an arcuate bottom wall 22. Bottom wall 22, in turn, continues in an arcuate configuration then merges with a front wall generally designated by reference numeral 24 and which is also substantially arcuate.

Thus, the walls defined therebetween a trough to receive rain which will run off from roof 16.

At the upper end of front wall 24, there is provided a somewhat C-shaped structure designated by reference numeral 26 and which terminates in an inwardly extending flange 28.

Gutter guard 10 is of a generally elongated configuration having a first side 38 and a second side 40. Intermediate first side 38 and second side 40 is a generally planar portion 42 having a plurality of apertures 44 formed therein.

At first side 38, gutter guard 10 has a first upwardly and inwardly extending segment 46 which then turns through 180° to merge with a downwardly extending segment 48. Second segment 48 lies adjacent to first segment 46, but is of a longer length. Second segment 48 terminates in a short inwardly curved segment 50.

At second side 40, there is provided an inverted U-shaped portion generally designated by reference numeral 52 and which comprises an upwardly extending wall segment 54 which reverses through 180° to join a downwardly extending wall segment 56. As may be seen in FIG. 3, U-shaped portion 52 fits over the upper portion of rear wall 20.

In use, and as may be seen in FIG. 3, first side 38 is placed within C-shaped portion 26 and inwardly extending flange 28 such that flange 28 contacts first segment 46 while the end of second segment 48 and inwardly curved segment 50 abut an opposite wall of C-shaped portion 26. Thus, the gutter guard acts to reinforce the eaves trough and provides a solid unitary structure.

Using this arrangement, the eaves trough guard may be secured by driving a suitable attachment member 55 (nail or screw) through wall 54, wall 20 and wall 56 into facia 14. The interlocking arrangement of the first and second sides of gutter guard 10 with the structure or eaves trough provides rigidity and support for the front of the eaves trough to prevent sagging thereof. Also, this method of attachment is far easier for the installer.

It will be understood that the above described embodiment is for purposes of illustration only and that changes or modifications may be made thereto without departing from the spirit and scope of the invention.

I claim:

1. A device for protecting a gutter wherein the gutter has a rear wall, a front wall and a bottom wall, said walls defining a trough having an open top therebetween, said gutter also having a generally C-shaped portion extending from an upper marginal edge of said front wall, an inwardly extending flange located at a distal end of said generally C-shaped portion, said generally C-shaped portion and flange defining a recess therebetween, said device comprising:

a guard member having an elongated configuration with a generally planar central portion, first and second longitudinally extending opposed sides located on either side of said generally planar central portion, a plurality of apertures extending through said generally planar central portion;

said first side of said guard member having an upwardly extending portion designed to fit within said recess, said upwardly extending portion from said first side of said guard member comprising a first segment extending upwardly and rearwardly to form an acute angle with said substantially planar portion, said first segment merging with a second segment aligned adjacent thereto in an 180° turn, the arrangement being such that said portion between said first and second segments abuts said C-shaped portion proximate said flange, and a distal end of said second segment abuts said C-shaped portion proximate said front wall; and said second side of said guard member having an upwardly extending wall designed to abut said rear wall of said gutter.

2. The device of claim 1 wherein said apertures are arranged in diagonal rows extending between said first and second longitudinally extending opposed sides.

3. The device of claim 2 wherein said apertures are circular in configuration and have a diameter of between 2.5 and 20 mm.

4. The device of claim 3 wherein said apertures have a diameter of between 3.0 and 4.0 mm.

5. The device of claim 3 wherein said diagonal rows extend at an angle of 45° with to said first and second longitudinally extending opposed sides, said apertures forming longitudinally extending rows, said apertures being spaced apart by a distance of between 10 and 15 mm in said longitudinally extending rows.

6. The device of claim 1 wherein said upwardly extending wall of said second side of said guard member merges with a downwardly extending wall segment to thereby form the U-shaped portion designed to fit over an upper marginal edge of said rear upper wall of said eavestrough.

7. In a building having a gutter for collecting water, the improvement wherein said gutter has an arcuate bottom wall, a rear upper wall merging therewith, and a front upper wall merging with said bottom wall, a generally C-shaped portion extending from an upper marginal edge of said front wall, an inwardly extending flange located at a distal end of said generally C-shaped portion;

said generally C-shaped portion and flange defining a recess therebetween; a guard member having an elongated configuration with a generally planar central portion, first and second longitudinally extending opposed sides located on either side of said generally central planar portion, a plurality of apertures extending through said generally planar central portion;

said first side of said guard member having an upwardly extending portion designed to fit within said recess; said upwardly extending portion from said first side of said guard member comprising a first segment extending upwardly and rearwardly to form an acute angle with said substantially planar portion, said first segment merging with a second segment aligned adjacent thereto in an 180° turn, the arrangement being such that said portion between said first and second segments abuts said C-shaped portion proximate said flange, and a distal end of said second segment abuts said C-shaped portion proximate said front wall; and said second side of said guard member having an upwardly extending wall abutting said rear wall of said gutter, said gutter being attached by fastening means extending through said upwardly extending wall from said second side of said gutter member and said rear wall of said gutter.

8. The improvement of claim 7 wherein said upwardly extending wall of said second side of said guard member merges with a downwardly extending wall segment to thereby form a U-shaped portion fitting over an upper marginal edge of said rear upper wall of said gutter.

* * * * *